US008188933B2

(12) United States Patent
Nakamura et al.

(10) Patent No.: US 8,188,933 B2
(45) Date of Patent: May 29, 2012

(54) ANTENNA UNIT AND MOBILE TERMINAL THEREWITH

(75) Inventors: Kouichi Nakamura, Fukuoka (JP); Takumi Naruse, Fukuoka (JP); Fumio Fukushima, Fukuoka (JP); Kuniaki Kiyosue, Fukuoka (JP)

(73) Assignee: Panasonic Corporation, Osaka (JP)

( * ) Notice: Subject to any disclaimer, the term of this patent is extended or adjusted under 35 U.S.C. 154(b) by 398 days.

(21) Appl. No.: 12/639,238

(22) Filed: Dec. 16, 2009

(65) Prior Publication Data

US 2010/0156735 A1 Jun. 24, 2010

(30) Foreign Application Priority Data

Dec. 17, 2008 (JP) ..... 2008-320450
Feb. 26, 2009 (JP) ..... 2009-043366

(51) Int. Cl.
*H01Q 7/08* (2006.01)

(52) U.S. Cl. ..... 343/788; 343/866; 343/867

(58) Field of Classification Search ..... 343/741, 343/787, 788, 866, 867
See application file for complete search history.

(56) References Cited

U.S. PATENT DOCUMENTS

| | | | | |
|---|---|---|---|---|
| 7,417,599 | B2 * | 8/2008 | Goff et al. | 343/867 |
| 7,446,729 | B2 * | 11/2008 | Maruyama et al. | 343/867 |
| 7,724,139 | B2 * | 5/2010 | Arguin | 340/572.1 |
| 7,924,235 | B2 * | 4/2011 | Fujimoto et al. | 343/787 |
| 2008/0007473 | A1 | 1/2008 | Yosui et al. | |
| 2009/0179812 | A1 | 7/2009 | Nakamura et al. | |
| 2009/0256777 | A1 | 10/2009 | Nagai | |

FOREIGN PATENT DOCUMENTS

JP 2008-48376 2/2008

* cited by examiner

*Primary Examiner* — Tan Ho
(74) *Attorney, Agent, or Firm* — Greenblum & Bernstein, P.L.C.

(57) ABSTRACT

An antenna unit includes an antenna formed on a magnetic sheet. A transmission circuit includes an inductor, a matching capacitor, and the antenna connected in series, and a reception circuit includes the antenna, the matching capacitor, a resistor, and a capacitor connected in series. The antenna is formed as one turn, and the size of the antenna and the resistor involves a predetermined relationship.

11 Claims, 7 Drawing Sheets

TRANSMISSION-RECEPTION CIRCUIT

ANTENNA UNIT AND MOBILE TERMINAL THEREWITH

BACKGROUND

1. Field of the Invention

This invention relates to an antenna unit installed in a small communication device of a mobile telephone, etc., and in particular to an antenna unit adapted to a communication device of a mobile telephone, etc., having an NFC (Near Field Communication) function and a mobile terminal using the antenna unit.

2. Description of the Related Art

Hitherto, for example, an IC card system has been widely known as a system for conducting proximity communications. In the IC card system, a reader/writer generates an electromagnetic wave, thereby forming an RF field (magnetic field). When the IC card is brought close to the reader/writer, the IC card receives power supply according to electromagnetic induction and transfers data to and from the reader/writer.

For example, NFC exists as a communication protocol for conducting proximity communications represented by the IC card system. In recent years, a mobile telephone has been caused to execute proximity communications in accordance with the NFC communication protocol and a communication device of a mobile telephone, etc., has been provided with a card function. Further, an art of reading information in a tag attached to a target through a mobile telephone using the NFC communication protocol is also proposed (reader function). Patent Document 1 discloses an example of an antenna unit for executing the NFC communication protocol.

Patent Document 1: JP2008-48376

However, to install an antenna unit in a mobile telephone, the antenna unit must also be small matched with the size of the mobile telephone. A chip antenna is considered as an antenna unit fitted for installation in a mobile telephone. To use a chip antenna, however, it becomes difficult to ensure a predetermined communication distance although there is a size merit. According to an experiment, to conduct proximity communications using a chip antenna, stable communications were able to be conducted only to a distance of about 5 mm. If proximity communications are conducted using a mobile telephone at this distance, in fact, communications cannot be conducted because of the thickness of the cabinet of the mobile telephone or the like. Even if an extremely thin cabinet is used, a mobile telephone and targets (reader/writer and tag) must be brought almost into contact with each other and the usability of the system is poor for the user.

As an antenna unit for executing NFC, it is desirable that proximity communications should be able to be conducted with spacing at a considerable distance (generally, about 30 mm). It is therefore an object of the invention to provide an antenna unit that can conduct proximity communications at a predetermined communication distance (30 mm) or more and has a size fitted to installation in a mobile telephone and a mobile terminal using the antenna unit.

SUMMARY

To accomplish the object, the invention provides an antenna unit including a coil section formed on a magnetic sheet, a transmission circuit connecting an inductor, a first capacitor, and the coil section in series, and a reception circuit connecting the coil section, the first capacitor, a resistance part, and a second capacitor in series, characterized in that the coil section is formed as one turn and the size of the coil (the dimension product of the length and the width) and the resistance part involves a predetermined relationship.

According to the invention, the antenna unit of the size that can be installed in a mobile telephone can be provided and the antenna unit capable of ensuring the communication distance fitted to proximity communications can be provided. Further, the following problem occurring because the small size is realized can be solved: The coil of one turn is used for the need for increasing the Q value of the antenna to increase output of the antenna at the antenna transmitting time. However, the induced voltage of the antenna at the antenna receiving time lowers and it becomes impossible to obtain a reception signal. However, the resistance value of the reception circuit is adjusted with the impedance converter matching the impedance of the one-turn coil, so that the problem can be solved and the small antenna unit excellent in communication characteristic can be provided.

DETAILED DESCRIPTION

Embodiments of the invention will be discussed below with the drawings:

Embodiment 1

Figure 1:
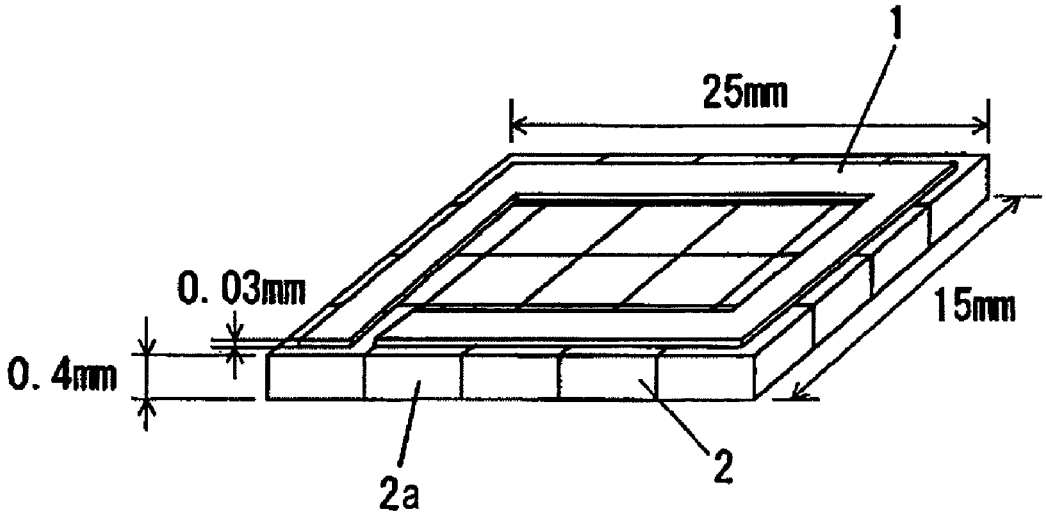
FIG. 1 is a configuration drawing to show an antenna unit in Embodiment 1 of the invention.

FIG. 1 is a configuration drawing to show an antenna unit in Embodiment 1 of the invention.

Numeral 1 denotes an antenna of a loop shape with one turn. Numeral 2 denotes a magnetic sheet provided below the antenna for decreasing the effect of metal on the periphery of the antenna; the magnetic sheet 2 is formed of a plurality of magnetic substances 2*a* each shaped like a fixed piece. In the embodiment, FIG. 1 shows the preferable size of three sides of the magnetic sheet 2 to miniaturize the antenna unit. This size is a size adapted for installation in a small communication device of a mobile telephone, etc. In the size, if an antenna of more than one turn is formed, a sufficient opening area of the antenna cannot be provided and it is difficult to provide the required communication distance. The sections making up the antenna unit will be discussed below in detail with FIG. 1:

To begin with, the antenna 1 will be discussed.

The antenna 1 is formed as a loop antenna of one turn. The structure of the antenna 1 may be a shape having an opening in the center, and the shape may be any of a circle, a rough rectangle, or a polygon. Such a structure is adopted, whereby a sufficient magnetic field can be provided and it is made possible to conduct communications between a wireless communication medium and a wireless communication medium processor because of occurrence of inductive power and mutual inductance.

Further, a material of the antenna 1 can be selected appropriately from a conducive metal wire rod, metal plate material, metal foil material, metal pipe material, etc., of gold, silver, copper, aluminum, nickel, etc., and can be formed by a metal line, metal foil, conductive paste, plating transfer, sputter, vapor deposition, or screen print.

Preferably, a material capable of holding a plurality of magnetic substances of metal plate materials, etc., is used as the material of the antenna 1; in the embodiment, a copper plate is used as the material of the antenna 1.

Next, the magnetic sheet 2 will be discussed.

The magnetic sheet 2 of the embodiment is a set of a plurality of magnetic substance fixed pieces 2*a* and is adjustably placed.

All magnetic substance fixed pieces are placed so that upper and lower faces become roughly the same faces, so that the maximum volume of the magnetic substance can be used in the range of the thickness dimension, the mechanical strength, and any other physical performance required for the magnetic sheet 2, and high magnetic performance can be provided.

The material of the magnetic sheet 2 is a metal material of ferrite, permalloy, sendust, a silicon alloy, etc. Soft magnetic ferrite is preferable as magnetic material; ferrite powder is dry-pressed and is calcined, whereby a burned (calcined) substance, a high-density ferrite burned substance can be produced. Preferably, the density of soft magnetic ferrite is 3.5 g/cm$^3$ or more. Further, preferably the size of the magnetic substance of soft magnetic ferrite is equal to or larger than the grain boundary. The magnetic sheet 2 is shaped like a sheet formed in a thickness of about 0.05 mm to 3 mm (or like a plate, like a film, or like a layer).

The soft magnetic ferrite may be made up of Ni—$ZnO_3$, ZnO, NiO, CuO, or $Fe_2O_3$, ZnO, MnO, CuO. Further, it may be a single layer of a magnetic substance of any of an amorphous alloy, permalloy, electromagnetic steel, silicon iron, an Fe—Al alloy, or a sendust alloy or may be a stacked substance of ferrite, amorphous foil, permalloy, electromagnetic steel, and sendust or may be a stacked substance using various magnetic substances in combination. To stack magnetic substances, the magnetic substances are stacked to form a stacked structure by at least one means of resin, ultraviolet hardening-type resin, visible light hardening-type resin, thermoplastic resin, thermosetting resin, heat resistant resin, synthetic rubber, double-side tape, an adhesive layer, or a film; the magnetic substances are shaped like fixed pieces as described above.

Further, the magnetic sheet 2 of the invention may be provided by coating a single body or a stacked body of ferrite, an amorphous alloy, permalloy, electromagnetic steel, silicon iron, an Fe—Al alloy, an sendust alloy with at least one means of resin, ultraviolet hardening-type resin, visible light hardening-type resin, thermoplastic resin, thermosetting resin, heat resistant resin, synthetic rubber, double-side tape, an adhesive layer, or a film.

The magnetic sheet 2 of the invention is coated with at least one means of resin, ultraviolet hardening-type resin, visible light hardening-type resin, thermoplastic resin, thermosetting resin, heat resistant resin, synthetic rubber, double-side tape, an adhesive layer, or a film, so that high flexibility, excellent durability, and high surface resistance can be provided and it is easy to form a circuit by antenna print, plating, etc., on a surface.

In the embodiment, the magnetic sheet 2 is provided by calcining an Ni—Zn based ferrite or Mn—Nn based ferrite material at 800° C. to 1000° C. and the calcined (burned) magnetic sheet 2 is coated with a protective member of protective tape, double-side tape, etc., and is crushed with a roller, etc., thereby producing the magnetic sheet 2 having flexibility.

The magnetic sheet 2 coated with a protective member has very excellent flexibility and can be easily subjected to punch molding by punching, etc., and thus can be formed as a complicated shape at a low cost and moreover can be molded in large quantities.

Further, the magnetic sheet 2 may be shaped roughly like a triangle pole, a square pole, a cylindrical column, a sphere, etc.

The magnetic sheet 2 of the invention is fixed with double-side tape, micro-adhesive tape, etc., and is crushed by a roller, whereby flexibility can be given to the magnetic sheet 2. Since the magnetic sheet 2 is crushed by a roller, workability of the magnetic sheet 2 improves and the load at the working time also lessens, so that the product cost can be reduced. Further, the magnetic sheet 2 is crushed by a roller, whereby a gap is produced in the magnetic sheet 2 and when a resin is printed on the magnetic sheet 2, the magnetic sheet 2 is impregnated with the resin and the resin acts as a binder and it is made possible to further provide the magnetic sheet 2 with flexibility.

The magnetic sheet 2 of the invention has the magnetic substances formed with a slit, whereby the magnetic sheet 2 can be easily divided and the magnetic sheet 2 excellent in flexibility and workability can be realized.

In the embodiment, the magnetic sheet using a set of magnetic substance fixed pieces as mentioned above is used. However, the magnetic sheet may be a magnetic sheet with magnetic powder mixed into a resin, or a conventional magnetic sheet may be used.

Next, FIG. 2 will be discussed.

Figure 2:
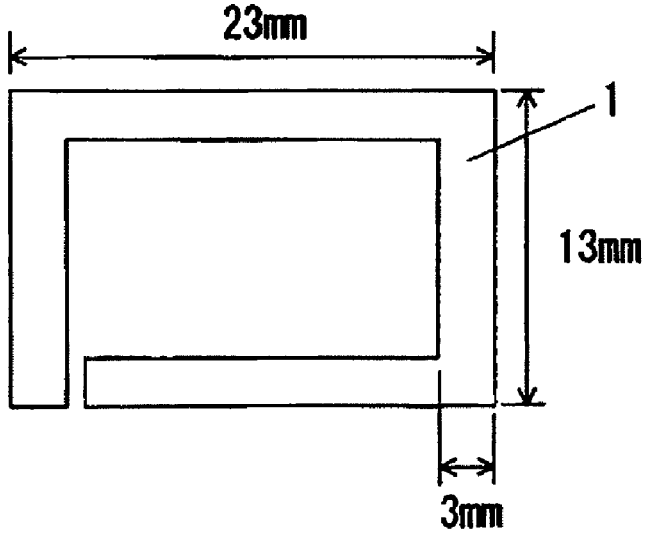
FIG. 2 is a schematic configuration drawing of an antenna in Embodiment 1 of the invention.

FIG. 2 is a schematic configuration drawing of the antenna 1 of the invention, and a coil of one turn is formed. The dimensions of the antenna 1 are based on the size of an SIM card and the width of the antenna 1 is 3 mm because of the maximum value of electromagnetic field simulation according to the Q value of the antenna 1 and the communication characteristic of the antenna 1.

In FIGS. 1, 5, 6, and 7 in the embodiment, the antenna unit is not provided with rear metal, but metal may be provided on the rear of the antenna unit for the purpose of preventing the resonance frequency of the antenna unit from changing according to the ambient environment. As the material of the rear metal at the time, generally copper foil is used; the material can be selected appropriately from a conducive metal wire rod, metal plate material, metal foil material, metal pipe material, etc., of gold, silver, copper, aluminum, nickel, etc., and can be formed by a metal plate, a metal line, metal foil, conductive paste, plating transfer, sputter, vapor deposition, or screen print.

Figure 5:
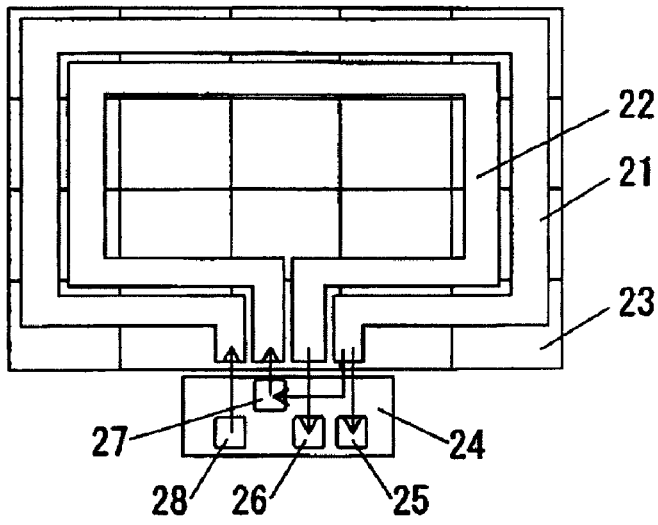
FIG. 5 is a top view of an antenna unit in Embodiment 2 of the invention.
Figure 6:
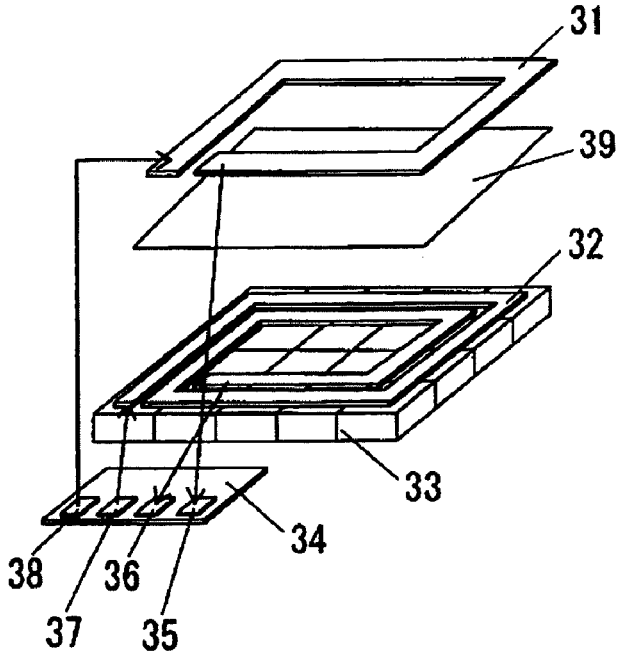
FIG. 6 is a configuration drawing when two antennas are used up and down in Embodiment 2 of the invention.
Figure 7:
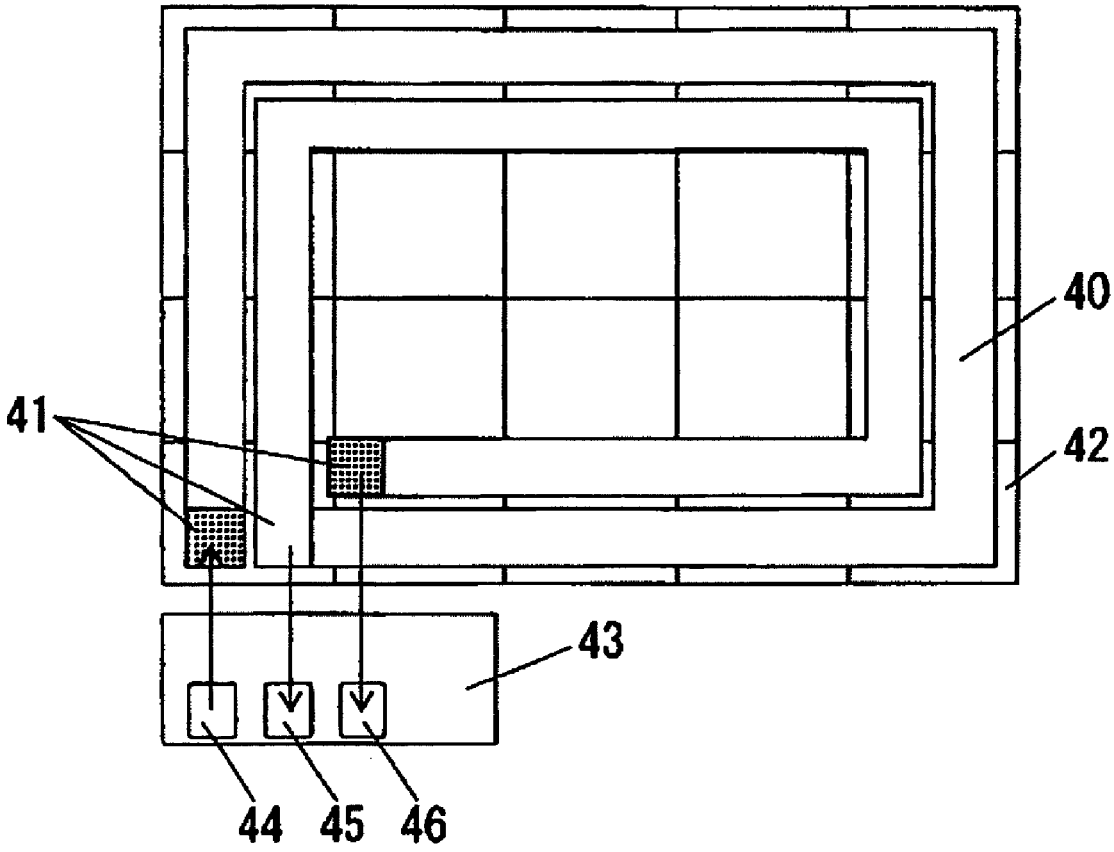
FIG. 7 is a configuration drawing when the antennas are used in Embodiment 2 of the invention.

A terminal of the antenna unit may be installed on any of the upper face, a side face, or the back face and the terminal position can be changed in response to the installation state of a machine in which the antenna unit is built. Connection to the antenna 1 using a switching circuit 24, 34, or 43 as shown in FIG. 5, 6, or 7 may be adopted; further connection to the antenna 1 using a connector, etc., does not introduce any problem.

FIG. 2 shows the dimensions of the antenna 1 of the embodiment to use the magnetic sheet 2 using the preferred size shown in FIG. 1. The antenna 1 and the magnetic sheet 2 using the sizes are used, whereby the antenna unit can be easily installed in a small communication terminal of a mobile telephone, etc.

Next, FIG. 3 will be discussed.

Figure 3:
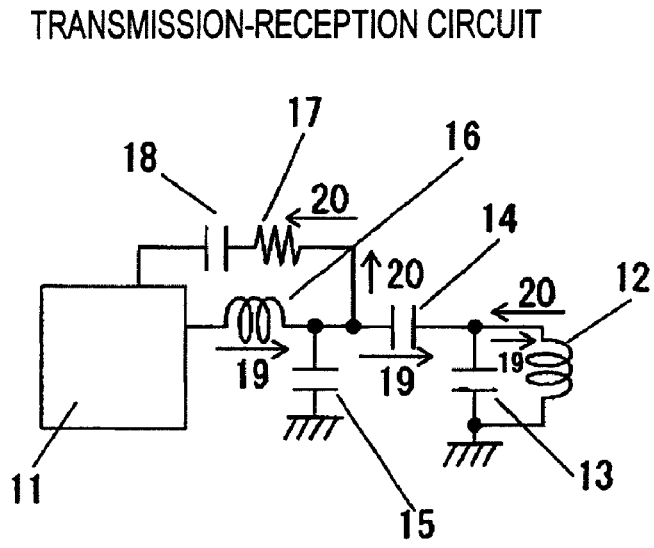
FIG. 3 is a circuit diagram of the antenna unit in Embodiment 1 of the invention.

FIG. 3 is a transmission-reception circuit diagram applied to the antenna unit of the invention. As shown in FIG. 3, the transmission-reception circuit is made up of an IC chip 11, an antenna 12, a resonance capacitor 13, a matching capacitor 14, a filter capacitor 15, a capacitor 18, an inductor 16, and a resistor 17.

In the circuit, at the transmitting time, a transmission signal output from the IC chip 11 passes through a low-pass filter and the matching capacitor 14 as an arrow 19 and reaches the antenna 12 and the antenna 12 is caused to produce a magnetic field for conducting communications. On the other hand, at the receiving time, induced voltage is produced by a magnetic field passing through an antenna coil and passes through the resistor 17 and the capacitor 18 as an arrow 20 and a reception signal is transmitted to the IC chip 11.

In the invention, a coil of one turn is used as the antenna 12 because of the necessity for increasing the Q value of the antenna 12 to maximize the power transmission at the reader/writer mode time of the antenna unit. The reader/writer mode means that the antenna unit functions as a reader/writer, and is a communication mode for transmitting a signal to a tag (IC card) of an associated party and receiving a signal from the tag. In the antenna 12 forming a loop antenna of three or four turns as in the conventional antenna unit, if it is miniaturized like the SIM size (25 mm×15 mm), a sufficient opening area of the antenna 12 cannot be provided and as the number of turns of the antenna 12 increases, the impedance of the antenna 12 increases. Consequently, the Q value of the antenna 12 decreases and a signal from the IC chip 11 cannot sufficiently be transmitted to the antenna 12 and the communication characteristic becomes 30 mm or less.

In the invention, to ensure the performance of the antenna 12 while realizing the SIM size, the antenna 12 is made a coil of one turn and the Q value of the antenna and the Q value of a circuit constant are increased, so that a signal from the IC chip 11 is transmitted to the antenna 12 at the maximum and it is made possible to ensure the communication characteristic 30 mm or more even in the antenna unit of the SIM size.

On the other hand, the antenna 12 is made a coil of one turn, whereby a problem of a decrease in the induced voltage in a tag mode of the antenna unit occurs. The tag mode means that the antenna unit functions as a tag (IC card), and is a communication mode for receiving a signal from an external reader/writer of an associated party and transmitting information in the antenna unit.

Figure 4:
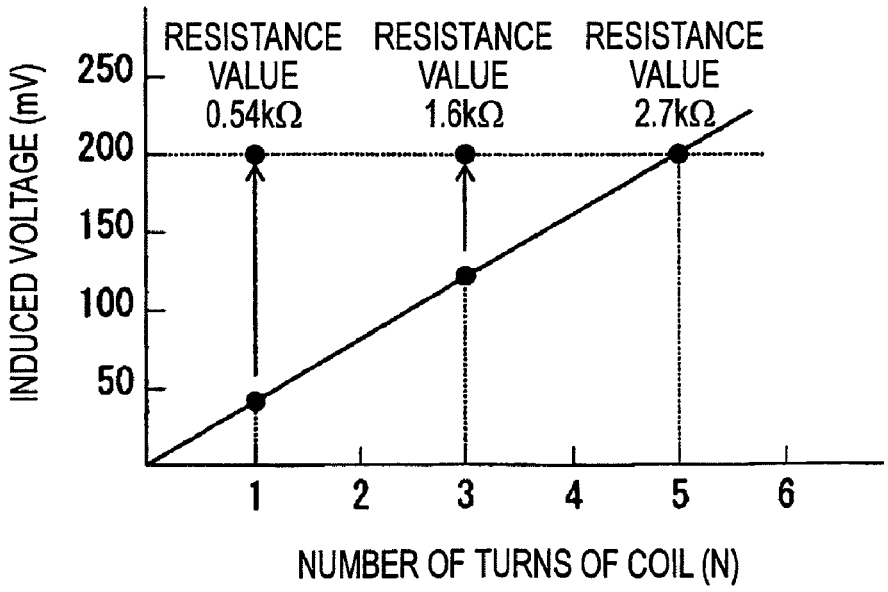
FIG. 4 is a relationship drawing between the number of turns and induced voltage in Embodiment 1 of the invention.

The induced voltage in the antenna 12 is represented as $Em=E0\times Q\times\mu e\times(2\pi\times N\times A/\lambda)$ where Em: Induced voltage, E0: Field intensity, Q: Antenna performance, μe: Effective magnetic permeability of magnetic sheet, N: Number of turns, A: Antenna area, and λ: Wavelength. It is seen that as the number of turns of the antenna coil, N, decreases, the induced voltage decreases as shown in FIG. 4. Therefore, if the antenna 12 of the antenna unit is made one turn, the induced voltage in the tag mode of the antenna unit lowers, a sufficient reception signal is not obtained, and it becomes impossible to conduct communications.

Then, in the invention, to supply a sufficient reception signal to the IC chip 11, the value of the resistor 17 is adjusted with a decrease in the number of turns of the antenna coil, as shown in FIG. 4. As is obvious from FIG. 4, if the antenna 12 is made one turn, it is necessary to set the resistance value of the resistor 17 to about 0.54 kΩ to ensure the preferred induced voltage (200 mV) of the IC chip 11.

A calculation method of the resistance value will be discussed below: In the antenna unit, resistance R of a reception circuit has the following relationship:

$$R=(S\times\mu e\times H\times Q\times 2\pi f)^2/W$$

where S: Product of dimensions of length and width of antenna 12, R: Resistance value of resistor 17, W: Drive power at the receiving time of IC chip 11, H: Magnetic field strength in antenna 12, Q: Antenna performance of antenna 12, μe: Effective magnetic permeability of magnetic sheet, and f: Frequency at the transmitting-receiving time.

Here, Q shows the antenna performance of the antenna 12; specifically it depends on the resistance value of the antenna 12, the number of turns of the antenna 12, and the like.

That is, the number of turns of the antenna 12 is changed from the conventional one, whereby the impedance of the antenna 12 changes and matching with the circuit portion of the antenna unit is not taken and thus the optimum value of the resistor 17 is derived according to the relation expression mentioned above.

The antenna size S at this time is the product of the dimensions of the length and the width of the antenna 12; in the embodiment, the antenna size becomes the product of the length dimension 23 mm and the width dimension 13 mm of the antenna unit, as shown in FIG. 2.

The magnetic field strength H mentioned above is the magnetic field strength applied to the antenna unit when the antenna unit is placed at a distance of 30 mm, and the antenna unit is optimized so that the antenna performance becomes good when the antenna unit is at a distance of 30 mm according to the expression mentioned above.

In addition to the method of adjusting the resistor 17 as described above, means for enhancing the reception sensitivity according to a method of increasing the voltage of the reception circuit with a transformer or a method of detecting the current of the reception circuit with a comparator and changing the current amount with a varactor diode or the like is available.

Using the means, although the antenna 12 formerly required more than one turn, it is made possible to provide communication characteristic 30 mm or more in the reader/writer mode and the tag mode with the antenna 12 of one turn.

As described above, the antenna unit having a size that can be installed in a mobile telephone can be provided and the antenna unit capable of ensuring the communication distance fitted to proximity communications can be provided.

To install the antenna unit in a mobile telephone, the antenna unit can be placed along the cabinet of the mobile telephone or can be placed in a battery pack or can be provided in space of a board in the cabinet.

The resistance value of the reception circuit is adjusted with an impedance converter matching the impedance of the antenna of one turn, whereby a small antenna unit excellent in communication characteristic can be provided.

Since the magnetic sheet is formed of a set of magnetic substance fixed pieces, an antenna unit excellent in flexibility and workability can be realized.

In addition, in this embodiment, although the size of the antenna unit is defined as above, the size can be arbitrarily changed.

Embodiment 2

Embodiment 2 of the invention will be discussed below with FIGS. 5 to 7. Detailed description is given invoking Embodiment 1.

FIG. 5 is a top view of an antenna unit in Embodiment 2 of the invention. In FIG. 5, an antenna 21 in a reader/writer mode and an antenna 22 in a tag mode are formed on the same plane and a magnetic sheet 23 is formed below the antennas 21 and 22.

The magnetic sheet 23 may be a resin layer if no metal body exists on the periphery of the antenna.

A switching circuit 24 is connected to the antennas 21 and 22 for switching terminals between the reader/writer mode and the tag mode. Numerals 25 and 28 denote terminals when the antenna unit is in the reader/writer mode and the terminals are connected to the antenna 21. Likewise, numerals 26 and 27 denote terminals when the antenna unit is in the tag mode and the terminals are connected to the antenna 22.

In the reader/writer mode, the antenna 21 of one turn is used, whereby the Q value of the antenna 21 is decreased and a transmission signal from an IC chip 11 is transmitted at the maximum. On the other hand, at the receiving time, the antenna is switched to the antenna 22 of a plurality of turns by the switching circuit, whereby the induced voltage at the receiving time is increased and a reception signal from the antenna 22 is transmitted to the IC chip 11. The mode may be switched automatically by detecting the mode and by the switching circuit or may be switched manually by the user.

The reason why the antenna 21 in the reader/writer mode is the outside and the antenna 22 in the tag mode is the inside is that preferably the antenna 21 in the reader/writer mode is large as much as possible because the IC chip of a tag with no power supply needs to be driven; on the other hand, the antenna 22 in the tag mode may be smaller than the antenna 21 in the reader/writer mode because a signal is sent from a reader/writer of an associated party to which power is supplied.

The antennas 21 and 22 are placed as in FIG. 5, whereby the antenna unit can be thinned and the need for placing an impedance converter, etc., in the reception circuit is eliminated. Thus, the antenna and connection to the circuit are devised without devising the circuit connected to the antenna, whereby the antenna unit compatible with the two modes can be provided without making large the size of the antenna.

Next, FIG. 6 will be discussed.

In FIG. 6, an antenna 31 in the reader/writer mode and an antenna 32 in the tag mode are formed up and down, and an insulating layer 39 is formed between the antenna 31 in the reader/writer mode and the antenna 32 in the tag mode. A magnetic sheet 33 is formed below the antennas 31 and 32; the magnetic sheet 33 may be a resin layer if no metal body exists on the periphery of the antenna. A switching circuit 34 is connected to the antennas 31 and 32 for switching terminals between the reader/writer mode and the tag mode.

In the reader/writer mode, the antenna 31 of one turn is used, whereby the Q value of the antenna 31 is decreased and a transmission signal from the IC chip 11 is transmitted at the maximum. On the other hand, at the receiving time, the antenna 32 of a plurality of turns is used, whereby the induced voltage at the receiving time is increased and a reception signal from the antenna 32 is transmitted to the IC chip 11.

The reason why the antenna 31 in the reader/writer mode is the upside and the antenna 32 in the tag mode is the downside is that preferably the antenna 31 in the reader/writer mode is close to a tag as much as possible because the IC chip of the tag with no power supply needs to be driven; on the other hand, the antenna 32 in the tag mode may be distant from the tag as compared with the antenna 31 in the reader/writer mode because a signal is sent from the reader/writer of an associated party to which power is supplied.

The antennas 31 and 32 are placed as in FIG. 6, whereby it is made possible to place the terminal positions of the antennas 31 and 32 in the antenna unit as desired. The antenna 32 in the tag mode can be made larger than the antenna 22 in FIG. 5 and it is made possible to increase the number of turns of the antenna 32 in the tag mode.

Next, FIG. 7 will be discussed.

FIG. 7 shows an antenna unit wherein in one antenna 40 formed on the same plane, an antenna signal is transmitted and received from connection terminals 41 installed in the antenna 40, whereby the antenna 40 can be changed to a coil of one turn or a coil of more than one turn as desired. A magnetic sheet 42 is formed below the antenna 40; the magnetic sheet 42 may be a resin layer if no metal body exists on the periphery of the antenna. A switching circuit 43 is connected to the antenna 40 for switching terminals between the reader/writer mode and the tag mode.

In the reader/writer mode, using terminals 44 and 45, the antenna is set to the antenna 40 of one turn, whereby the Q value of the antenna 40 is decreased and a transmission signal from the IC chip 11 is transmitted at the maximum. On the other hand, at the receiving time, using terminals 44 and 46, the antenna is set to the antenna 40 of a plurality of turns, whereby the induced voltage at the receiving time is increased and a reception signal from the antenna 40 is transmitted to the IC chip 11.

The antenna 40 is formed as in FIG. 7, whereby the antenna having the functions of the reader/writer mode and the tag mode on the same plane can be easily manufactured and the thin antenna unit can be provided at a low cost.

As described above, the antennas 1, 21, 22, 31, 32, and 40 according to the invention are set, whereby the small antenna unit can be manufactured at a low cost and moreover it is made possible to ensure the communication distance of the antenna unit 30 mm or more.

Embodiment 3

Embodiment 3 of the invention will be discussed below with FIGS. 8 and 9. Detailed description is given invoking Embodiments 1 and 2.

Figure 8:
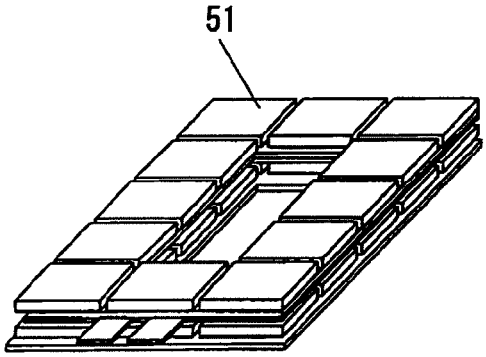
FIG. 8 is a configuration drawing to show an antenna unit in Embodiment 3 of the invention.
Figure 8:
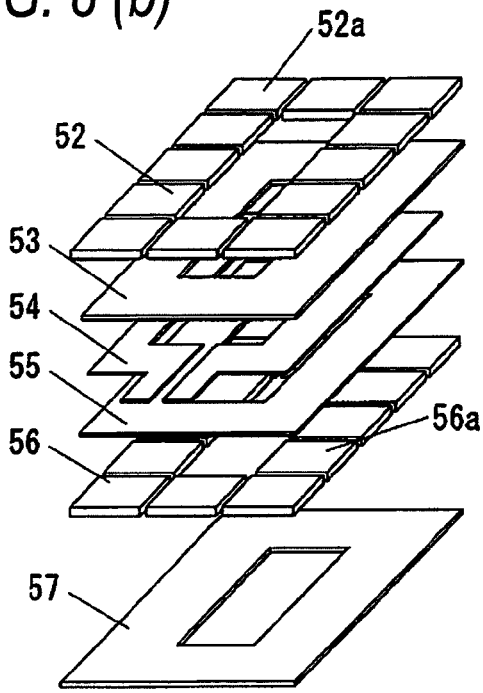

FIG. 8 is a configuration drawing to show an antenna unit in Embodiment 3 of the invention. As shown in FIG. 8 (*a*), an antenna unit 51 is of a stack structure; as shown in FIG. 8 (*b*), a reinforcement member 52, a resin sheet 53, an antenna 54, a resin sheet 55, a magnetic sheet 56, and a metal plate 57 are stacked in order from the top, and an opening is provided in the center.

The components will be discussed in detail.

First, the antenna 54 can use any material described above; in the embodiment, a copper plate is used.

Next, the magnetic sheet 56 can use any material described above; in the embodiment, ferrite is used and cell-shaped blocks 56*a* are combined to form the annular magnetic sheet 56.

Next, the resin sheet 55 will be discussed. As the resin sheet 55, for example, a resin represented by photo-setting resin, thermoplastic resin, thermosetting resin, heat resistant resin, etc., is used; in the embodiment, epoxy resin is used and the antenna 54 and the magnetic sheet 56 are adhered by thermo-compression bonding.

Here, in the embodiment, further metal particles of alumina, etc., for example, are mixed in the resin sheet 55 as a filler.

Accordingly, shrinkage of resin occurring when they are adhered by thermo-compression bonding can be suppressed and variations in performance of the antenna unit 51 can be suppressed.

Since the thickness of the resin sheet 55 can be provided to some extent by the filler, the resin sheet 55 can provide a gap between the antenna 54 and the magnetic sheet 56 and consequently the communication characteristic of the antenna unit 51 can be enhanced and particularly variations in frequencies can be decreased.

In the embodiment, sheet resin is used for adhering, but a liquid adhesive may be applied to the antenna 54 or the magnetic sheet 56.

Next, the reinforcement member 52 will be discussed. The reinforcement member 52 is provided for insulating the antenna 54 from other members while ensuring the strength of the antenna unit 51. It is made of a material harder than the magnetic sheet 56, namely, a material with large transverse rupture strength; for example, ceramics of alumina ($Al_2O_3$), zirconia ($ZrO_2$), etc., and rigid plastic can be named. In the embodiment, alumina is used.

The reinforcement member 52 is formed using cell-shaped blocks 52*a* in combination like the magnetic sheet 56.

Accordingly, the whole strength of the antenna unit 51 can be improved and a crack, etc., of the magnetic sheet 56 occurring when the antenna unit 51 is bent can be decreased.

In the embodiment, the reinforcement member 52 is used from the viewpoint of the strength and the insulation properties; however, considering only the insulation properties, cathodic electrodeposition may be performed for the portion of the antenna 54 for insulation or coating with a resin may be executed.

Particularly, to coat with a resin, the antenna 54 and the magnetic sheet 56 may be put and then a resin may be applied to the whole by dip coating or a resin may be applied to the surface of the antenna 54 or the opposite face to the antenna 54 for coating or the resin sheet, etc., described above may be put, thereby protecting the surface while ensuring the insulation properties.

Next, the resin sheet 53 will be discussed.

The resin sheet 53 is provided for bonding the antenna 54 and the reinforcement member 52 together; in the embodiment, the same sheet as the resin sheet 55 described above is used, but any may be used if it bonds the antenna 54 and the reinforcement member 52 together.

Last, the metal plate 57 is provided for decreasing variations in performance when the antenna unit 51 is placed on a metal face; it need not be provided if the antenna unit 51 is placed on a metal face or if the effect on the antenna unit 51 is small.

Next, the dimensions of the antenna unit 51 will be discussed in detail. FIG. 9 is a schematic drawing show the antenna unit in Embodiment 3 of the invention.

Figure 9:
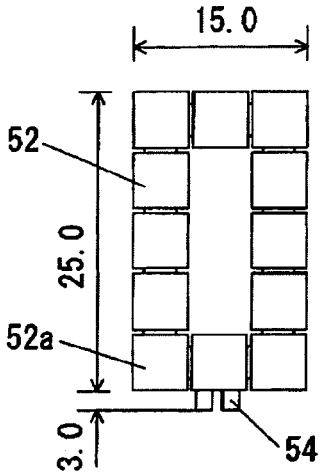
FIG. 9 is a schematic drawing to show the antenna unit in Embodiment 3 of the invention.
Figure 9:
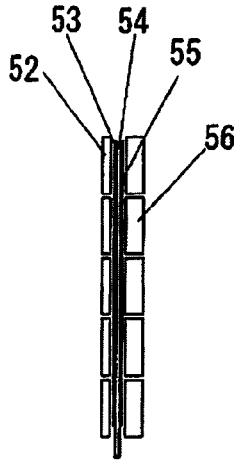
Figure 9:
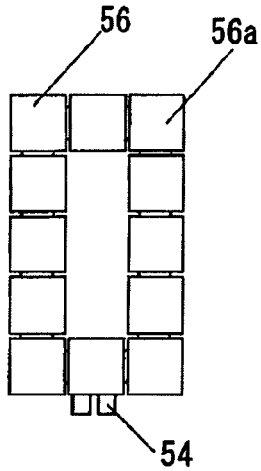

FIG. 9 (*a*) is a top view of the antenna unit 51. The size of the antenna unit 51 is 25.0 mm×15.0 mm and the electrode portion of the antenna 54 is extended about 3 mm to the outer periphery.

One block 52*a* of the reinforcement member 52 is shaped like a square so that the blocks can be combined into various forms. The size of the block is 4.8 mm×4.8 mm in the embodiment; the blocks 52*a* are spaced 0.2 mm from each other to as to easily bend when the blocks are combined.

FIG. 9 (*b*) is a side view of the antenna unit 51. The reinforcement member 52 has a thickness of 0.2 mm, the resin sheet 53, 55 has a thickness of 0.09 mm, the antenna 54 has a thickness of 0.1 mm, and the magnetic sheet 56 has a thickness of 0.4 mm.

The thickness of the resin sheet 53, 55 described above is the thickness after thermo-compression bonding; in the embodiment, a resin sheet having a thickness of 0.11 mm is used.

Accordingly, as described above, the resin sheet 55 can provide a gap between the antenna 54 and the magnetic sheet 56 and consequently the communication characteristic of the antenna unit 51 can be enhanced and particularly variations in frequencies can be decreased.

That is, if the gap between the antenna 54 and the magnetic sheet 56 is set specifically in the range of 0.05 mm to 0.1 mm, the communication characteristic can be enhanced; in the embodiment, the resin sheet 55 is set to 0.09 mm, whereby the communication characteristic are enhanced.

FIG. 9 (*c*) is a bottom view of the antenna unit 51. One block 56*a* of the magnetic sheet 56 is shaped like a square so that the blocks can be combined into various forms. The size of the block is the same as that of the block 52*a* of the reinforcement member 52, namely, is 4.8 mm×4.8 mm in the embodiment.

Accordingly, the reinforcement member 52 and the magnetic sheet 56 are made the same size, thus the block sizes of both faces of the antenna 54 become the same and thus when the antenna unit 51 is bent, it can be easily bent.

Figure 10:
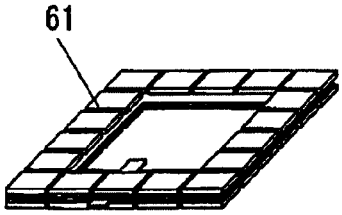
FIG. 10 is a configuration drawing to show another antenna unit in Embodiment 3 of the invention.
Figure 10:
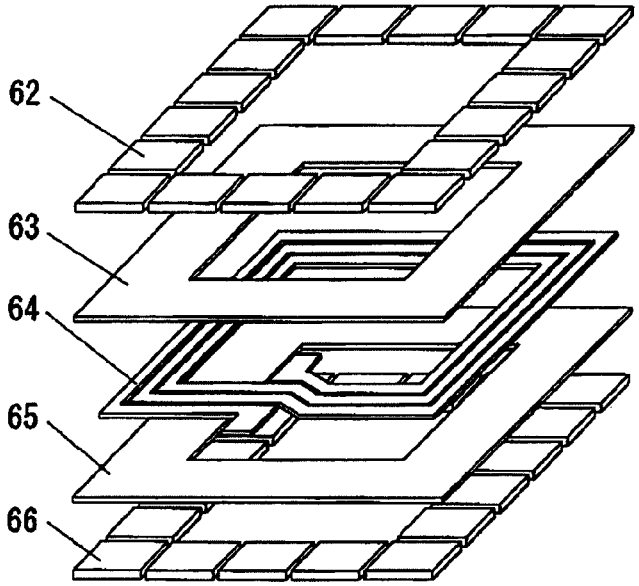

As described above, usually, considering the size of the antenna unit to install in a mobile telephone, if the antenna is formed to a plurality of turns, the opening area lessens and thus it is not preferred; if the size of the antenna unit is made large, a shape as in FIG. 10 is considered.

As shown in FIG. 10, an antenna unit 61 has a reinforcement member 62, a resin sheet 63, an antenna 64, a resin sheet 65, and a magnetic sheet 66, which are stacked in order. The antenna 64 is formed of a loop of a plurality of turns and an electrode is provided on the opening side and the outer periphery side.

At this time, in the embodiment, cell-shaped blocks are used for both the reinforcement member and the magnetic sheet and are combined, whereby the size of the antenna unit can be changed easily and antenna units different in size can be created easily.

Embodiments 1 to 3 can also be used in combination.

As described above, the antenna unit of the invention includes the coil section formed on the magnetic sheet, the transmission circuit connecting the inductor, the first capacitor, and the coil section in series, and the reception circuit connecting the coil section, the first capacitor, the resistance part, and the second capacitor in series. The coil section is formed as one turn and the size of the coil (the dimension product of the length and the width) and the resistor involves the predetermined relationship, so that the antenna unit of the size that can be installed in a mobile telephone can be provided and the antenna unit capable of ensuring the communication distance fitted to proximity communications can be provided. Further, the following problem occurring because the small size is realized can be solved: The coil of one turn is used for the need for increasing the Q value of the antenna to increase output of the antenna at the antenna transmitting time. However, the induced voltage of the antenna at the antenna receiving time lowers and it becomes impossible to obtain a reception signal. However, the resistance value of the reception circuit is adjusted with the impedance converter matching the impedance of the one-turn coil, so that the problem can be solved and the small antenna unit excellent in communication characteristic can be provided.

The antenna unit of the invention includes the coil section formed on the magnetic sheet, the transmission circuit connecting the inductor, the first capacitor, and the coil section in series, and the reception circuit connecting the coil section, the first capacitor, the resistance part, and the second capacitor in series. The magnetic sheet is made up of at least a plurality of fixed piece magnetic substances and the resistance part involves the predetermined relational expression, so that the antenna unit that can conduct communications at the predetermined distance fitted to proximity communications in the predetermined size and has flexibility can be provided.

The coil section is shaped like a plate, thus the fixed piece magnetic substances can be held by the coil section.

Further, the reinforcement member of a plurality of fixed pieces is provided on the opposite face of the coil section to the magnetic sheet and the reinforcement member is harder than the magnetic substances, so that the whole strength of the antenna unit can be ensured while flexibility is ensured.

The magnetic sheet of the fixed piece magnetic substances and the fixed piece reinforcement member are the same in size, so that the while antenna unit can be bent easily.

As described above, the antenna unit of the invention is a wireless communication medium processor for supplying power and transmission data to a wireless communication medium of a non-contact IC card, an IC tag, etc., stored on a commodity shelf, etc., and acquiring reception data from the wireless communication medium by load fluctuation; it can also be applied to applications where the communication range is enlarged, such as drug management, dangerous article management, and valuable management systems in addition to a storage shelf and an exhibition shelf where automatic commodity management, book management, etc., is made possible.

This application claims the benefit of Japanese Patent Application No. 2008-320450 filed on Dec. 17, 2008 and Japanese Patent Application No. 2009-043366 filed on Feb. 26, 2009, the entire contents of which are incorporated herein by reference.

What is claimed is:

1. An antenna unit, comprising:

a coil section formed on a magnetic sheet;

a transmission circuit in which an inductor, a first capacitor, and the coil section are connected in series; and a reception circuit in which the coil section, the first capacitor, a resistance part, and a second capacitor are connected in series;

wherein the coil section is formed as one turn and the size of the coil and the resistance part involves the following relationship:

$$R=(S\times\mu e\times H\times Q\times 2\pi f)^2/W$$

where S: Product of dimensions of length and width of the coil section, R: Resistance value of the resistance part, W: Drive power at the IC chip receiving time, H: Magnetic field strength in the coil section, Q: Antenna performance, μe: Effective magnetic permeability of the magnetic sheet, and f: Frequency at the transmitting-receiving time.

2. The antenna unit as claimed in claim 1, wherein the magnetic sheet is composed of at least a plurality of fixed piece magnetic substances.

3. The antenna unit as claimed in claim 2, wherein a reinforcement member of a plurality of fixed pieces is provided on the opposite face of the coil section to the magnetic sheet and the reinforcement member is harder than the magnetic substances.

4. The antenna unit as claimed in claim 3, wherein the magnetic sheet of the fixed piece magnetic substances and the fixed piece reinforcement member are the same in size.

5. The antenna unit as claimed in claim 1, wherein the coil section is shaped as a plate.

6. The antenna unit as claimed in claim 1, wherein the magnetic sheet is placed along the outer shape of the coil section.

7. A mobile terminal in which the antenna unit as claimed in claim 1 is installed internally.

8. An antenna unit, comprising:

a first coil composed of one turn formed on a magnetic sheet;

a second coil composed of one turn formed on the same plane as the first coil on the magnetic sheet;

a first connection terminal connected to one end part of the first coil;

a second connection terminal connected to one end part of the second coil;

a third connection terminal connected to an opposite end part of the second coil and selectively connected to an opposite end part of the first coil; and a fourth connection terminal selectively connected to the opposite end part of the first coil.

9. The antenna unit as claimed in claim 8, wherein the first coil to be used in a reader/writer mode is placed outside from the second coil to be used in a tag mode.

10. The antenna unit as claimed in claim 8, further comprising:

a switch section for switching so as to connect the opposite end part of the first coil to the fourth connection terminal in the reader/writer mode and connect the opposite end part of the first coil to the third connection terminal in the tag mode.

11. An antenna unit, comprising:

a coil section formed on a magnetic sheet;

a transmission circuit in which an inductor, a first capacitor, and the coil section are connected in series; and a reception circuit in which the coil section, the first capacitor, a resistance part, and a second capacitor are connected in series;

wherein the magnetic sheet is composed of at least a plurality of fixed piece magnetic substances and the resistance part involves the following relationship:

$$R=(S\times\mu e\times H\times Q\times 2\pi f)^2/W$$

where S: Product of dimensions of length and width of the coil section, R: Resistance value of the resistance part, W: Drive power at the IC chip receiving time, H: Magnetic field strength in the coil section, Q: Antenna performance, μe: Effective magnetic permeability of the magnetic sheet, and f: Frequency at the transmitting-receiving time.

* * * * *